US006767181B2

(12) United States Patent
Yu et al.

(10) Patent No.: US 6,767,181 B2
(45) Date of Patent: Jul. 27, 2004

(54) FUEL PUMP

(75) Inventors: DeQuan Yu, Ann Arbor, MI (US); Sheven Sharp, Troy, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/268,519

(22) Filed: Oct. 10, 2002

(65) Prior Publication Data

US 2004/0071542 A1 Apr. 15, 2004

(51) Int. Cl.[7] ..... F01D 1/12

(52) U.S. Cl. ..... 415/55.1

(58) Field of Search ..... 415/55.1–55.7, 415/169.1

(56) References Cited

U.S. PATENT DOCUMENTS

| | | | | | |
|---|---|---|---|---|---|
| 1,920,484 | A | | 8/1933 | Siemen et al. | 103/96 |
| 4,804,313 | A | | 2/1989 | Nasvytis | 415/53 |
| 5,024,578 | A | | 6/1991 | Vansadia | 415/55.1 |
| 5,215,429 | A | | 6/1993 | Sun | 415/55.4 |
| 5,284,417 | A | | 2/1994 | Yu | 415/55.1 |
| 5,310,308 | A | | 5/1994 | Yu et al. | 415/55.6 |
| 5,330,319 | A | | 7/1994 | Yu et al. | 415/55.1 |
| 5,336,045 | A | * | 8/1994 | Koyama et al. | 415/55.1 |
| 5,364,238 | A | | 11/1994 | Yu | 417/423.14 |
| 5,375,971 | A | | 12/1994 | Yu | 415/55.1 |
| 5,375,975 | A | | 12/1994 | Yu et al. | 415/182.1 |
| 5,401,143 | A | | 3/1995 | Yu | 417/203 |
| 5,401,147 | A | | 3/1995 | Yu | 417/423.14 |
| 5,409,357 | A | | 4/1995 | Yu et al. | 417/423.1 |
| 5,487,650 | A | | 1/1996 | Gaston et al. | 417/423.3 |
| 5,513,950 | A | | 5/1996 | Yu | 415/55.1 |
| 5,549,446 | A | | 8/1996 | Gaston et al. | 415/55.1 |
| 5,551,835 | A | * | 9/1996 | Yu et al. | 415/55.1 |
| 5,551,842 | A | | 9/1996 | Schmid et al. | 417/203 |
| 5,702,229 | A | * | 12/1997 | Moss et al. | 415/55.4 |
| 5,733,111 | A | | 3/1998 | Yu et al. | 418/78 |
| 5,762,469 | A | | 6/1998 | Yu | 415/55.1 |
| 5,819,524 | A | | 10/1998 | Bosley et al. | 60/39.465 |
| 5,921,746 | A | | 7/1999 | Yu et al. | 415/55.1 |
| 5,984,644 | A | | 11/1999 | Yu et al. | 417/302 |
| 6,068,454 | A | | 5/2000 | Gaston et al. | 417/356 |
| 6,113,360 | A | | 9/2000 | Yu et al. | 417/310 |
| 6,116,850 | A | | 9/2000 | Yu | 415/55.1 |
| 6,152,687 | A | * | 11/2000 | Wilhelm et al. | 415/55.1 |
| 6,170,472 | B1 | | 1/2001 | Gaston et al. | 123/509 |
| 6,174,128 | B1 | | 1/2001 | Yu | 415/55.2 |
| 6,210,102 | B1 | | 4/2001 | Yu et al. | 415/55.1 |
| 6,231,318 | B1 | | 5/2001 | Cotton et al. | 417/423.1 |
| 6,270,310 | B1 | | 8/2001 | Gaston et al. | 415/55.1 |
| 6,296,439 | B1 | | 10/2001 | Yu et al. | 415/55.1 |
| 6,299,406 | B1 | | 10/2001 | Yu et al. | 415/55.1 |
| 6,305,900 | B1 | | 10/2001 | Yu | 415/55.1 |
| 6,354,279 | B2 | | 3/2002 | Gaston et al. | 123/509 |
| 6,491,028 | B1 | | 12/2002 | Gaston et al. | 123/509 |
| 6,527,505 | B2 | | 3/2003 | Yu et al. | 415/55.1 |

(List continued on next page.)

*Primary Examiner*—Edward K. Look
*Assistant Examiner*—J. M. McAleenan
(74) *Attorney, Agent, or Firm*—John Kajander, Esq.

(57) ABSTRACT

A pump includes a pump casing and an impeller. The pump casing has an axis and comprises a cover having a face surface and a body positioned about the axis. A channel is defined in the face surface of the cover. An inlet opening extends through the cover and is coupled to the channel. The channel has a first section and a second section. The first section extends from the inlet opening and is continually sloped relative to the face surface of the cover. The first section has a length of about 40 to about 90 degrees, as measured circumferentially on the face surface of the cover about the axis. The first section includes an inlet ramp, a main ramp, and a secondary ramp, with the secondary ramp being positioned between the main ramp and the inlet ramp, and the inlet ramp being positioned adjacent the inlet opening. Each ramp has at least one depth and at least one slope.

28 Claims, 2 Drawing Sheets

U.S. PATENT DOCUMENTS

| | | | | |
|---|---|---|---|---|
| 6,561,765 | B2 | 5/2003 | Yu et al. | 416/195 |
| 6,604,905 | B1 | 8/2003 | Yu et al. | 415/55.1 |
| 6,641,361 | B2 | 11/2003 | Yu | 415/55.1 |
| 6,655,909 | B2 | 12/2003 | Yu et al. | 415/55.1 |
| 6,669,437 | B2 | 12/2003 | Yu et al. | 415/55.1 |
| 6,675,777 | B2 | 1/2004 | Gaston et al. | 123/509 |
| 6,675,778 | B1 | 1/2004 | Kemper et al. | 123/516 |
| 6,688,844 | B2 | 2/2004 | Yu | 415/55.1 |
| 2004/0001769 | A1 | 1/2004 | Kempfer et al. | 417/423.1 |
| 2004/0018080 | A1 | 1/2004 | Yu et al. | 415/55.1 |

* cited by examiner

FUEL PUMP

FIELD OF THE INVENTION

The claimed invention relates to a rotary pump. In particular, the invention relates to a fuel pump having an inlet ramp with desirable characteristics.

BACKGROUND OF THE INVENTION

Regenerative fuel pumps are used in vehicles to pump fuel from a fuel tank through a fuel handling system to the engine of the vehicle. Fuel pumps typically include a driven ring impeller that rotates within a pump casing. The impeller has an upstream side and a downstream side. The pump casing includes a cover that is positioned adjacent the upstream side of the impeller and a body that is positioned adjacent the downstream side of the impeller. The pump casing also includes a cup, which serves as the outer shell that houses the cover, impeller, body and other pump parts.

The ring impeller has vanes, which are bounded by annular channels defined in the casing. The channels are positioned at the upstream and downstream sides of the impeller vanes within the casing. The channel at the upstream side of the impeller provides fuel to the impeller while the channel at the downstream side expels fuel from the impeller.

The channel at the upstream side of the impeller includes an inlet through which fuel enters the impeller. The upstream channel may include a ramp or several ramps depending on the design. It is desirable to limit the amount of vapor generated within the upstream channel. Vapor reduction helps to improve pump efficiency, which furthers high fuel flow rates under hot fuel conditions. The upstream channel may include a vapor vent hole, through which vapor may escape to minimize vapor within the fuel as it passes through the fuel pump.

SUMMARY

A pump comprises a pump casing and an impeller. The pump casing has an axis and comprises a cover having a face surface and a body positioned about the axis. An arcuate channel is defined in the face surface of the cover and extends at least partially circumferentially about the axis. An inlet opening extends through the cover and is coupled to the arcuate channel. The impeller is positioned between the face surface of the cover and the body. The arcuate channel has a first section and a second section, with the first section extending from the inlet opening and being continually sloped relative to the face surface of the cover. The first section has a length of about 40 to about 90 degrees, as measured circumferentially on the face surface of the cover about the axis. The first section includes an inlet ramp, a main ramp, and a secondary ramp. The secondary ramp is positioned between the main ramp and the inlet ramp, and the inlet ramp is positioned adjacent the inlet opening. Each ramp has a depth and a slope. The depth of the inlet ramp is greater than the depth of the secondary ramp, and the depth of the secondary ramp is greater than the depth of the main ramp. The slope of each ramp is different from the slope of the other ramps.

The invention also concerns a cover incorporating the arcuate channel discussed above.

BRIEF DESCRIPTION OF THE DRAWING FIGURES

DETAILED DESCRIPTION OF THE INVENTION

Figure 1:
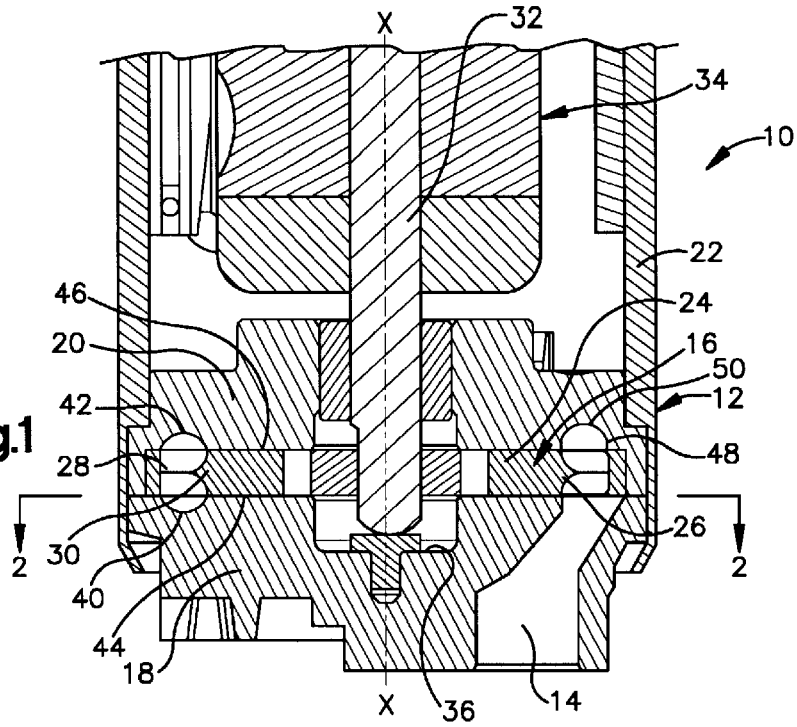
FIG. 1 is a cross-sectional view of part of a fuel pump utilizing a channel according to the invention.

FIG. 1 depicts a cross-section of a lower part of a fuel pump 10 utilized in a vehicle to pump fuel from a fuel tank to the vehicle engine. The fuel pump 10 is configured to be positioned in a fuel tank and to pump fuel from the fuel tank upwardly through the fuel pump 10. The fuel pump 10 includes a pump casing 12, an inlet 14, an outlet (not shown), and an impeller 16, all of which are positioned about a longitudinal axis X—X of the pump 10. The pump casing includes a cover 18, a body 20 and a cup 22, among other parts. The cover 18 is positioned upstream from and adjacent to the impeller 16 while the body 20 is positioned downstream from and adjacent to the impeller 16. The cover 18 includes the fuel inlet 14 and the body 20 includes the fuel outlet. The cup 22 serves as the outer housing for the fuel pump 10 and houses the cover 18, the body 20, the impeller 16, and other fuel pump parts.

The impeller 16 is used to move fuel through the fuel pump 10 and includes a disk-like body 24 having a ring of vanes 26 that are coupled to and extend outwardly from the outer periphery of the body 24. The vanes 26 have an outer end 28 and are connected to the impeller disk 24 at a vane root 30. The vanes 26 are spaced relative to one another and define chambers therebetween. The impeller 16 is rotatable about the longitudinal axis X—X of the pump 10 about a shaft 32 and positioned between the cover 18 and the body 20 of the pump 10. The shaft 32 is driven by an electric motor 34. Power is supplied to the electric motor 34 through the vehicle's alternator or battery. The shaft 32 extends through the body 20 and the impeller disk 24, and seats in a central opening 36 defined in the cover 18. The cover 18 and body 20 are stationary within the cup 22 of the pump casing 12.

The cover 18 and body 20 both include pumping channels 40, 42 that are circumferentially defined in the face surfaces 44, 46 of the cover 18 and body 20 about the longitudinal axis X—X. The channels 40, 42 extend arcuately around the face surfaces 44, 46 of the cover 18 and body 20 near the outer periphery thereof. In a preferred embodiment, shown in FIG. 2, the channel 40 on the cover 18 follows a generally circular path that is adjacent the path of the impeller vanes 26. Other paths may also be utilized, if so desired. The channel 40 defined in the cover 18 is referred to herein as the upstream channel 40 and the channel 42 defined in the body 20 is referred to herein as the downstream channel 42.

The upstream and downstream channels may have a cross-section that is semi-circular, arcuate, rectangular, or combinations thereof. In a preferred embodiment, shown best in FIG. 3, the upstream channel 40 has flat side walls 48 that are perpendicular to the face surface 44 of the cover 18 and an arcuate, semi-circular base wall 50 that is generally parallel to the face surface 44 of the cover 18.

It is preferred that the upstream and downstream channels 40, 42 be positioned in the vicinity of the vanes 26 of the impeller 16. In a preferred embodiment, the upstream channel 40 has a width that is equal to the length of the impeller vanes 26, from the vane ends 28 to the vane roots 30. The downstream and upstream channels 40, 42 serve as feed channels for the inlet and outlet of fuel from the impeller 16. When the impeller 16 rotates, fuel enters the upstream channel 40 through the inlet opening 14, is pumped through the impeller 16, is expelled through the outlet, and, at the same time, fuel flows through the impeller 16 into the downstream channel 42, where it is expelled through the outlet.

Figure 2:
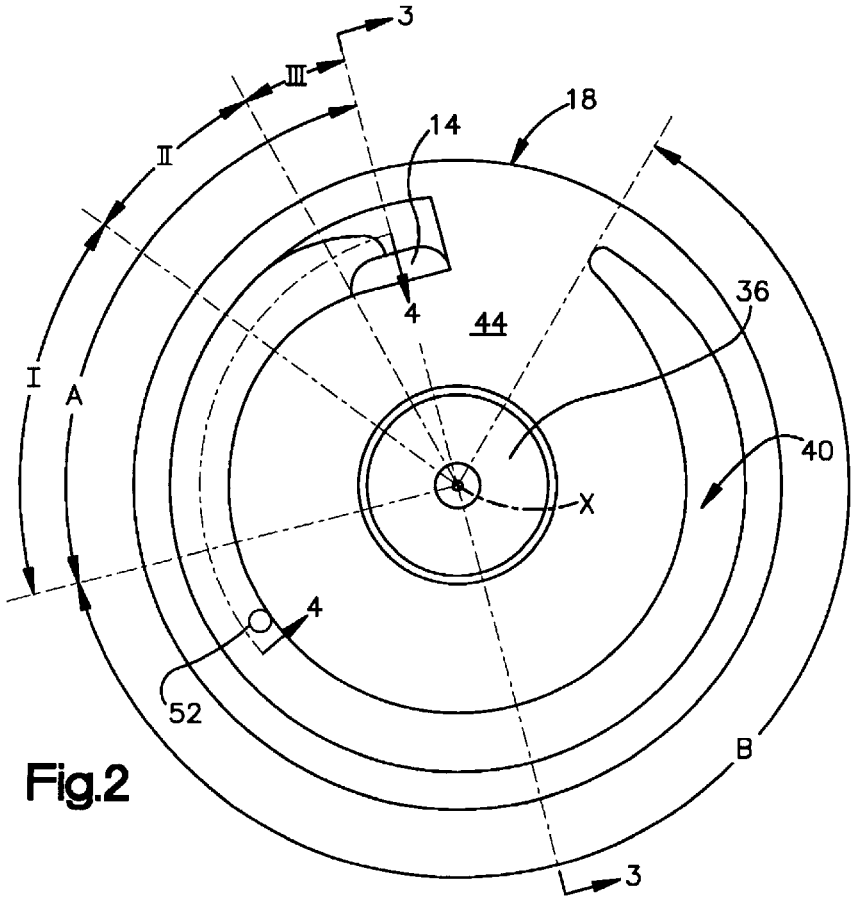
FIG. 2 is a plan view of a cover of the fuel pump, as taken at line 2—2 in FIG. 1.

The upstream channel 40 preferably extends around a significant portion of the face surface 44 of the cover 16. As shown in FIG. 2, in a preferred embodiment, the upstream channel 40 extends about 320 degrees around the circumference of the cover face surface 44. In another embodiment, the upstream channel 40 may extend between about 300 and 330 degrees around the circumference of the face surface 44 of the cover 16, the invention not being limited to a particular length of the upstream channel 40.

Figure 4:
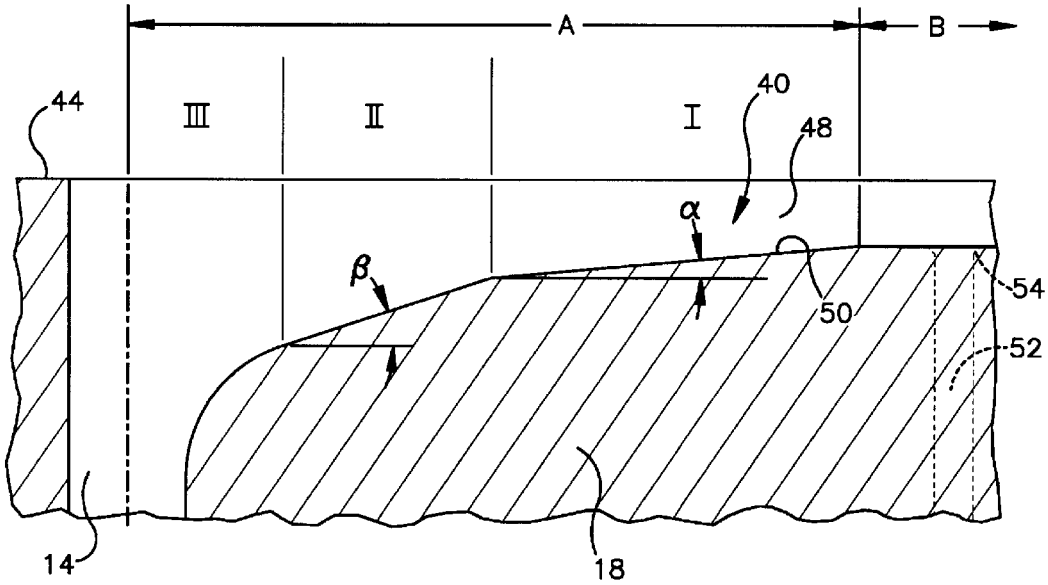
FIG. 4 is a cross-sectional view of the upstream channel taken at line 4—4 in FIG. 2.

It is preferred to reduce the local velocity of fuel as it approaches the impeller 16 and to reduce vapor generation within the upstream channel 40 to improve the performance characteristics of the fuel pump 10, particularly in high fuel flow applications (approximately 150–200 liters per hour) under hot fuel conditions. According to the invention, the upstream channel 40 has a geometry that assists in reducing the local velocity of the fuel and reducing vapor generation. In particular, as shown in FIG. 4, the upstream channel 40 incorporates a first section A and a second section B. The invention concerns the first section A. The second section B can be any current or future design known to those of skill in the art, the invention not being limited to a particular design for the second section B of the upstream channel 40.

The first section A of the upstream channel 40 utilizes a "double ramp" design. This double ramp includes a main ramp I, a secondary ramp II, and an inlet ramp III. The first section preferably extends between about 40 to about 90 degrees of the circumference of the face surface 44 of the cover 18, as measured about the longitudinal axis of the pump 10 from the inlet opening 14.

Referring to FIGS. 2 and 4, the main ramp I preferably has a length of approximately 60% of the length of the total first section A length. The main ramp I can have a single constant slope, or multiple slopes. The main ramp I has approximately the same outer diameter as the vane ends 28 of the impeller 16 and has an inner diameter that is about 0–1.5 mm smaller than the vane roots 30, with 1.0 mm being preferred. The main ramp I has a depth, where it meets the secondary ramp II, of approximately 2 to 6 mm. In a preferred embodiment, the depth of the main ramp I, where it meets the secondary ramp II, is 4 mm. The main ramp I has a ramp up angle a that is approximately 15 degrees or less. In a preferred embodiment, the main ramp I has a ramp up angle $\alpha$ of 7 degrees.

The secondary ramp II of the first section A preferably has a length of approximately 30% of the total length of the first section, or about half of the length of the main ramp I. The secondary ramp II may have a single slope, or multiple slopes. In the embodiment shown in FIG. 2, the secondary ramp II turns slightly radially inwardly to meet the inlet ramp III, although other configurations for the positioning of the inlet ramp III may also be utilized. The secondary ramp II has approximately the same outer diameter as the vane ends 28 of the impeller 16 and has an inner diameter that is about 0–1.5 mm smaller than the vane roots 30. In a preferred embodiment, the inner diameter of the secondary ramp II is 1.0 mm smaller than the vane roots 30. The secondary ramp II has a depth that is deeper than the depth of the main ramp I, and preferably about 4 to 8 mm. One end of the secondary ramp II is connected to the main ramp I while the other end is connected to the inlet ramp III. In a preferred embodiment, the depth of the secondary ramp II at the inlet ramp III is about 7 mm while the depth of the secondary ramp II at the main ramp I is about 5 mm. The secondary ramp II preferably has a ramp up angle $\beta$ of less than 30 degrees. In a preferred embodiment, the ramp up angle $\beta$ of the secondary ramp II is 15 degrees.

Figure 3:
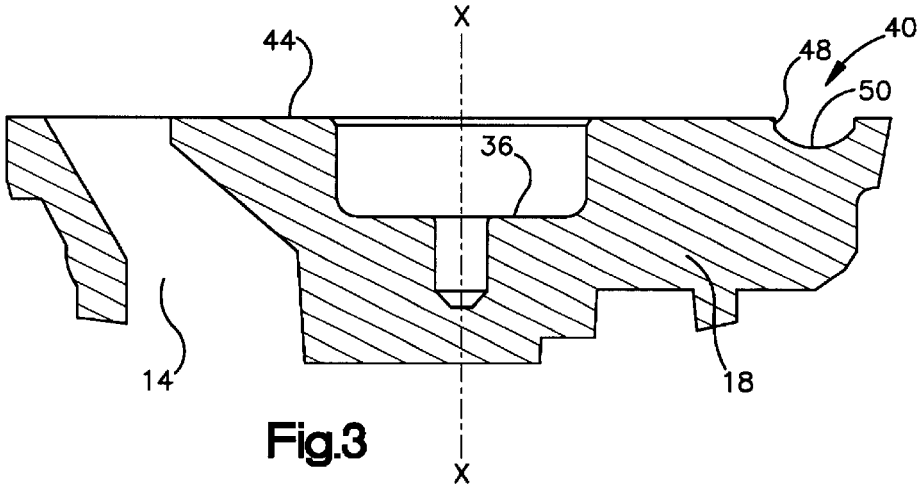
FIG. 3 is a cross-sectional view of the cover taken at line 3—3 in FIG. 2.

The inlet ramp III of the first section A preferably has a length of approximately 10% of the length of the double ramp and includes a smooth, rounded corner that connects the inlet opening 14 to the upstream channel 40. The inlet opening 14, at the upstream channel 40, has a radius of about 2 mm or greater. In one embodiment, the inlet opening 14 has a radius of about 3 to 4 mm. As shown in FIGS. 1–3, the inlet opening 14 is angled such that only part of the cross-section of the opening is fully visible when viewed from the face surface 44 of the cover 16. As shown in FIG. 2, the inlet opening 14, where it meets the upstream channel 40, takes on a semicircular shape. The inlet ramp III surrounds the inlet opening 14 and steeply curves from the inlet opening 14 to meet the secondary ramp II. The inlet ramp III preferably provides a smooth transition between the inlet opening 14 and the secondary ramp II.

The upstream channel 40 also preferably includes a vapor purge hole 52. The vapor purge hole 52, shown in FIGS. 2 and 4, is utilized to allow any vapor that forms in the fuel, as it enters the upstream channel 40, to exit before entering the impeller 16. The vapor purge hole 52 is preferably positioned about 90 to 180 degrees from the inlet opening 14 and includes a chamfered entrance 54 to avoid any cavitation that may be caused by a sharp corner within the channel 40. In one embodiment, the vapor purge hole 52 is positioned at about 110 degrees from the inlet 14. The vapor purge hole 52 may be positioned on the base wall 50 or on the side wall 48 of the upstream channel 40. The vapor purge hole 52 has a size of about 0.7 to 2 mm in diameter. In one embodiment, the vapor purge hole 52 is 1.25 mm.

While the invention has been described in connection with a longitudinal axis X—X of the pump 10, other axes, which are not necessarily aligned with the longitudinal axis X—X, may be utilized. The longitudinal axis X—X is used as a reference point for measuring the angular length of the channel 40. The length may be alternatively calculated from an axis defined by the cover 18 or impeller 16, the invention not being limited to a particular axis.

While various features of the claimed invention are presented above, it should be understood that the features may be used singly or in any combination thereof. Therefore, the claimed invention is not to be limited to only the specific embodiments depicted herein.

Further, it should be understood that variations and modifications may occur to those skilled in the art to which the claimed invention pertains. The embodiments described herein are exemplary of the claimed invention. The disclosure may enable those skilled in the art to make and use embodiments having alternative elements that likewise correspond to the elements of the invention recited in the claims. The intended scope of the invention may thus include other embodiments that do not differ or that insubstantially differ from the literal language of the claims. The scope of the present invention is accordingly defined as set forth in the appended claims.

What is claimed is:

1. A pump comprising:

a pump casing having an axis and comprising a cover having a face surface and a body positioned about the axis, with an arcuate channel defined in the face surface of the cover and extending at least partially circumferentially about the axis;

an inlet opening extending through the cover and coupled to the arcuate channel; and an impeller positioned between the face surface of the cover and the body, wherein the arcuate channel has a first section and a second section, with the first section extending from the inlet opening and being continually sloped relative to the face surface of the cover, said first section having a length of about 40 to about 90 degrees, as measured circumferentially on the face surface of the cover about the axis, said first section including an inlet ramp, a main ramp, and a secondary ramp, with the secondary ramp being positioned between the main ramp and the inlet ramp, and the inlet ramp being positioned adjacent the inlet opening, wherein each ramp has a depth and a slope, with the depth of the inlet ramp being greater than the depth of the secondary ramp, and the depth of the secondary ramp being greater than the depth of the main ramp, and the slope of each ramp is different from the slope of the other ramps.

2. The pump of claim 1, wherein the secondary ramp has a slope of less than or equal to about 30 degrees relative to the face surface of the cover.

3. The pump of claim 1, wherein the main ramp has a slope of less than or equal to about 15 degrees relative to the face surface of the cover.

4. The pump of claim 1, wherein the inlet ramp comprises about 10% of the first section, the secondary ramp comprises about 30% of the first section, and the main ramp comprises about 60% of the first section.

5. The pump of claim 1, wherein the secondary ramp has a length that is about half the length of the main ramp.

6. The pump of claim 1, wherein the secondary ramp has a depth of about 4 mm to about 8 mm where it meets the inlet ramp, and the main ramp has a depth of about 2 mm to about 6 mm where it meets the secondary ramp.

7. The pump of claim 1, wherein the depth of inlet ramp varies, the depth of the secondary ramp varies, and the depth of the main ramp varies, the slope of the main ramp is generally constant, and the slope of the secondary ramp is generally constant.

8. The pump of claim 1, wherein the channel has an at least partially arcuate cross-section.

9. The pump of claim 1, wherein the impeller includes an inner disk and a plurality of vanes extending outwardly from an outer periphery of the inner disk, with the vanes each having an end and a root, and the channel has a width substantially equal to the distance between the vane end and the vane root.

10. The pump of claim 1, further comprising a vent purge hole positioned in the channel and extending through the cover.

11. The pump of claim 1, wherein the main ramp has a length, the secondary ramp has a length, and the inlet ramp has a length, and the length of the main ramp is greater than the combined length of the secondary ramp and inlet ramp.

12. The pump of claim 1, wherein the main ramp has a length, the secondary ramp has a length, and the inlet ramp has a length, and the length of the main ramp is about double the length of the secondary ramp.

13. The pump of claim 1, wherein the first section of the arcuate channel has an outer diameter and the impeller includes a plurality of vanes having an outer vane diameter, with the outer diameter of the first section being the same as the outer vane diameter.

14. A cover for a pump casing comprising:

a disc-shaped member having a longitudinal axis and a face surface, with an arcuate channel defined in and extending around the face surface; and an inlet opening extending through the member and coupled to the channel, wherein the channel has a first section and a second section, with the first section extending from the inlet opening and being continually sloped relative to the face surface of the member, said first section having a length of about 40 to about 90 degrees, as measured circumferentially on the face surface of the member about the axis, said first section including an inlet ramp, a main ramp, and a secondary ramp, with the secondary ramp being positioned between the main ramp and the inlet ramp, and the inlet ramp being positioned adjacent the inlet opening, wherein each ramp has a depth and a slope, with the depth of the inlet ramp being greater than the depth of the secondary ramp, and the depth of the secondary ramp being greater than the depth of the main ramp, and the slope of each ramp is different from the slope of the other ramps.

15. The cover of claim 14, wherein the secondary ramp has a slope of less than or equal to about 30 degrees relative to the face surface of the member.

16. The cover of claim 14, wherein the main ramp has a slope of less than or equal to about 15 degrees relative to the face surface of the member.

17. The cover of claim 14, wherein the depth of inlet ramp varies, the depth of the secondary ramp varies, and the depth of the main ramp varies, the slope of the main ramp is generally constant, and the slope of the secondary ramp is generally constant.

18. The cover of claim 14, wherein the inlet ramp comprises about 10% of the first section, the secondary ramp comprises about 30% of the first section, and the main ramp comprises about 60% of the first section.

19. The cover of claim 14, wherein the secondary ramp has a length that is about half the length of the main ramp.

20. The cover of claim 14, wherein the secondary ramp has a depth of about 4 mm to about 8 mm where it meets the inlet ramp, and the main ramp has a depth of about 2 mm to about 6 mm where it meets the secondary ramp.

21. The cover of claim 14, wherein the channel has an at least partially arcuate cross-section.

22. The cover of claim 21, wherein the channel has flat side walls that are perpendicular to the face surface of the member, and an arcuate bottom wall.

23. The cover of claim 21, wherein the cross-section of the channel is at least partially semi-circular.

24. The cover of claim 14, further comprising a vent purge hole positioned in the channel and extending through the member.

25. The cover of claim 24, wherein the vent purge hole is positioned at about 90 to 180 degrees from the inlet opening, when measured circumferentially about the longitudinal axis.

26. The pump of claim 14, wherein the main ramp has a length, the secondary ramp has a length, and the inlet ramp has a length, and the length of the main ramp is greater than a combined length of the secondary ramp and inlet ramp.

27. The pump of claim 14, wherein the main ramp has a length, the secondary ramp has a length, and the inlet ramp has a length, and the length of the main ramp is about double the length of the secondary ramp.

28. The pump of claim 14, wherein the first section of the arcuate channel has an outer diameter and the impeller includes a plurality of vanes having an outer vane diameter, with the outer diameter of the first section being the same as the outer vane diameter.

* * * * *